US006071072A

United States Patent [19]

Chang

[11] Patent Number: 6,071,072

[45] Date of Patent: Jun. 6, 2000

[54] SELF-PRIMING CENTRIFUGAL PUMP

[76] Inventor: Wan-Te Chang, No. 12, Lane 139, Chiu-Chiung St., Lu-Chou Hsiang, Taipei Hsien, Taiwan

[21] Appl. No.: 09/203,465

[22] Filed: Dec. 2, 1998

[51] Int. Cl.[7] ..... F04D 9/02

[52] U.S. Cl. ..... 415/56.2; 415/56.4; 415/56.5; 415/56.6; 417/200; 417/423.5; 417/424.1

[58] Field of Search ..... 415/56.2, 56.3, 415/56.4, 56.5, 56.6, 143; 417/199.2, 200, 423.5, 424.1, 423.14

[56] References Cited

U.S. PATENT DOCUMENTS 4,624,627 11/1986 Tunks ..... 417/199 A 5,599,171 2/1997 Horwitz ..... 417/199.2

*Primary Examiner*—Edward K. Look
*Assistant Examiner*—Ninh Nguyen
*Attorney, Agent, or Firm*—Kirkpatrick & Lockhart LLP

[57] ABSTRACT

A self-priming centrifugal pump has a recirculation tube connected between a hollow cylinder having a first set of impellers received therein and a first tube having liquid received therein and having a second set of impellers received in one end thereof, so that the suction lift of liquid is enhanced and the liquid flow subjected only to the gravity will also be expedited by the extra centrifugal effect created by the second impeller. Furthermore, there are provided with a plurality of through holes communicating with the first tube. Therefore, the amount of liquid flow back to the first tube is increased.

4 Claims, 3 Drawing Sheets

SELF-PRIMING CENTRIFUGAL PUMP

BACKGROUND OF THE INVENTION

1. Field of the Invention

The present invention relates to a self-priming centrifugal pump, in particular, a pump with a guiding tube and a set of impeller to expedite the flow of fluid downstream so as to achieve the purpose of draining fluid upward from water supply.

2. Description of Related Art

A centrifugal pump will not move liquid unless it is primed. A pump is said to be "primed" when the pump casing and the suction piping are completely filled with liquid. Units that are located below the liquid level of the suction tank can be primped by merely opening the suction and discharge valves, thereby allowing liquid to flow into the pump by gravity. Conventional centrifugal pumps that are located above the suction level must be primed by some auxiliary means such as a vacuum pump, or a ejector. These means of priming chemical pumps are generally unsatisfactory because of the corrosive nature of the liquids being handled. Foot valves are sometimes used on the lower end of the suction line so that it is possible to fill the pump and piping with liquid from an outside source; but this method demands an elevated tank to store the priming liquid. All of these systems require someone to be present to operate the auxiliary equipment initially, and to reprime the pump should it become air-bound during operation.

The self-priming pump is one answer to the above problems. It primes itself, it will reprime if it becomes air bound during operation, and does not require constant attention during operation. However, every time when the self-priming pump starts to move liquid from the supply, air within the piping will slow down the velocity of priming, and the duration of priming the pump will therefore be prolonged and the efficiency reduced, until the air within the piping is fully expelled and there is nothing but liquid within the piping.

The present invention aims to provide an improved self-priming centrifugal pump to obviate or diminish the aforementioned problems.

The self-priming centrifugal pump of the invention has a recirculation tube and an extra set of impellers through which the lifting of air within the piping will be expedited and the liquid returned back to the pump is not only by gravity, but also by the centrifugal effect created by the extra impeller.

Furthermore, a secondary objective of the invention is that a plurality of through holes are provided to the periphery of the seat which has an opening defined to receive an axle and returned liquid therethrough, thereby increasing the speed of liquid returning to the pump.

DETAILED DESCRIPTION OF PREFERRED EMBODIMENT

A self-priming centrifugal pump has the capability of efficiently removing the air from the suction piping.

Removal of this air creates a partial vacuum in the suction line, allowing atmospheric pressure to force liquid from the source into piping between the pump and the source and into the pump, thereby establishing prime. Such a pump must be capable of forming a seal above the impeller so that atmospheric pressure cannot work back through the discharge line to break the vacuum. Finally, a self-priming pump must function efficiently as a standard centrifugal pump after it has been primed and establishes flow. No matter what design the centrifugal pump may have, it functions in the same manner. That is, it retains a certain amount of priming liquid when the pump is shut-down or loses prime, and the pump recirculates the priming liquid in such a way as to entrain air at its inlet side and to release it at its discharge side.

Figure 1:
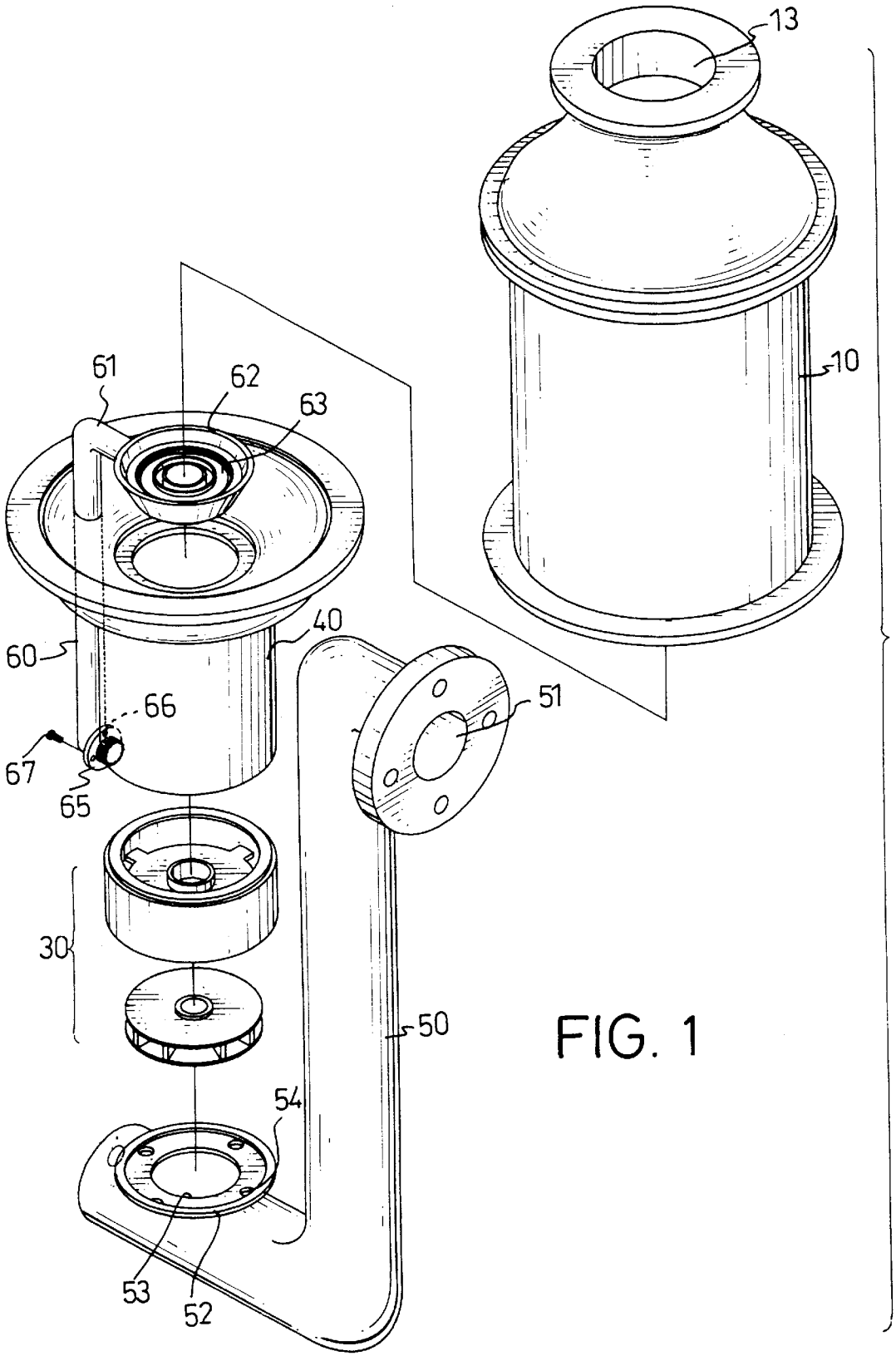
FIG. 1 is an exploded view showing components of a self-priming centrifugal pump constructed in accordance with the present invention.
Figure 2:
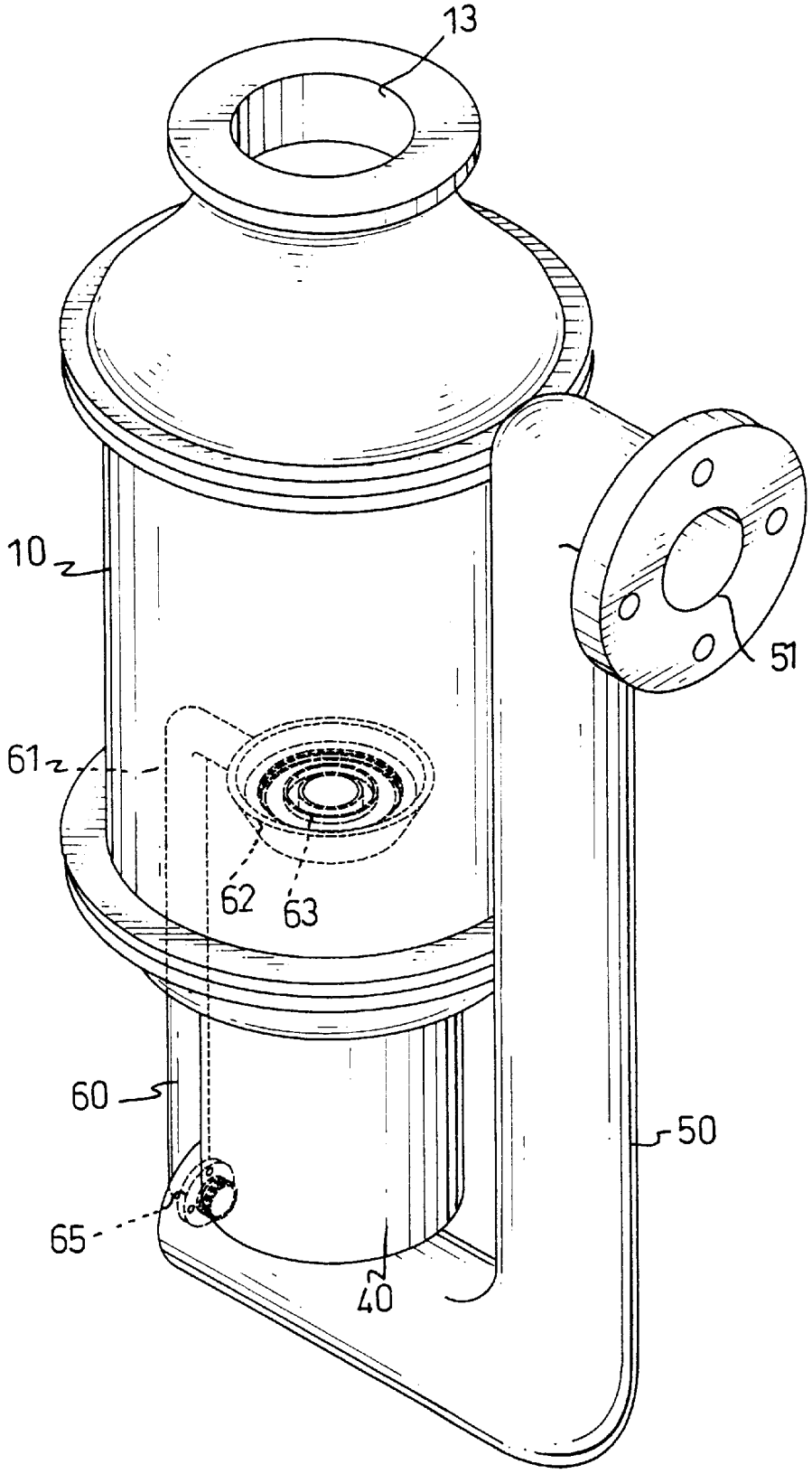
FIG. 2 is a perspective schematic view showing the unique feature of the pump shown in FIG. 1.

For this reason, the piping of the self-priming feature must be sealed tightly against the entrance of outside air. During the priming cycle particularly, the piping is under vacuum and air that enters from the outside must be removed in exactly the same manner as that from the suction piping. This increases the priming time; and may prevent priming altogether. To reduce the risk of interrupting a pumping cycle of a self-priming centrifugal pump, a recirculation tube feeds back a portion of the discharged liquid to the pump and an extra set of impellers which is mounted on top of the recirculation tube to increase suction lift and reduce priming time are provided. To have a better understanding of the invention, a preferred embodiment is introduced in FIGS. 1, 2 and 3.

As shown in the accompanying drawings, a self-priming centrifugal pump comprises a casing (10), a motor casing (11) securely mounted in the casing (10), a channel (12) defined between the casing (10) and the motor casing (11), a discharge end (13) on top of the casing (10) and in communication with the channel (12), a rotor (14) mounted within the motor casing (11), an axle (16) securely mounted with the rotor (14) and rotatably within the casing (10), a set of impellers (30) securely connected with the axle (16), a hollow cylinder (40) securely connected under the casing (10) and having the impellers (30) received therein, a first tube (50) communicating with the cylinder (40) through an opening (53) defined in a seat (52) securely mounted thereon, and a supply tube (70) connected between an inlet end (51) of the first tube (50) and a liquid supply. It is to be remembered that there is always a certain amount of air in the piping line, such as the first tube (50) and the supply tube (70), therefore, when the rotor (16) rotates, the rotation of the impellers (30) will create a suction lift to the priming liquid in the first tube (50), as well as the air. Due to the presence of the air, the liquid will not be able to be pumped directly out from the discharge end (13), the priming liquid together with the air will first be lifted by suction generated by the rotation of the impeller (30) and then the liquid will be splashed onto the periphery of the cylinder (40) under the centrifugal effect of the impellers (30). The air originally in the piping escapes from the discharge end (13). The lifted liquid will flow back to the first tube (50) for recirculation until all the air is expelled from the piping.

Figure 3:
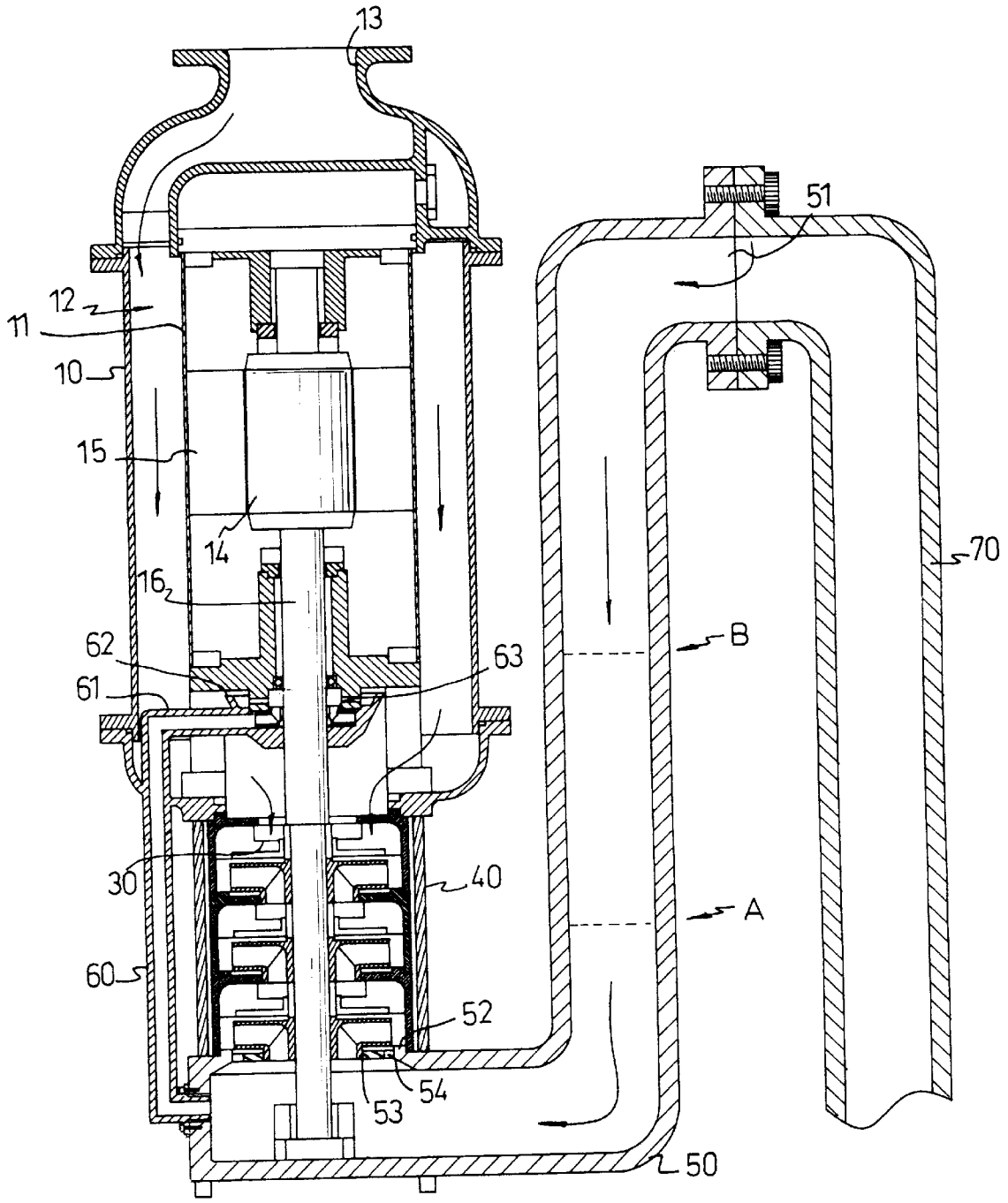
FIG. 3 is a schematic in partial cross sectional showing the movement of liquid under not only the effect of gravity, but also the operation of an extra set of impellers in combination with a recirculation tube.

To expedite the speed of recirculation of liquid and the expulsion of air in the piping, a recirculation tube (60) having an extra set of impeller (63) on an end thereof and in communication with the first tube (50) is provided. A first end of the recirculation tube (60) has a receiving seat (62) for receiving the impeller (63) therein and the axle (16) therethrough. A second end of the recirculation tube (60) is securely connected with the first tube (50). Such that when the liquid level reaches mark "A", as shown in FIG. 3, the separation of the liquid and the air is in the same manner as a conventional one. However, when the liquid level reaches mark "B", due to the level being above the impeller (63), the suction lift to the liquid is enhanced and the liquid back to the first tube (50) will not only be returned by gravity but also the centrifugal effect caused by the impeller (63). That is, the liquid subjected to the centrifugal effect of the impeller (63) will additionally flow from the recirculation tube (60) back to the first tube (50), which increases the efficiency of suction lift and reduces the priming time as well.

Furthermore, a plurality of through holes (54) are defined in a periphery defining the opening (53) of the seat (52), thereby increasing the amount of liquid flowing back to the first tube (50).

A self-priming centrifugal pump constructed in accordance with the present invention has the following advantages:

1. Increasing priming efficiency

When the liquid level is around the first set of impellers, the separation of the liquid from the air is based on the effect of gravity. Although the invention still applies the same principle, the flow of liquid back to the first tube is expedited due to the provision of the plurality of through holes. When the liquid level is above the first set of impellers and around the second set of impellers, the separation of the liquid from the air is expedited because the flow of liquid back to the first tube (50) is accomplished in two different ways, one through the opening (53) and the through holes (54) and the other is through the recirculation tube (60).

2. Shortening the priming time

Because the priming efficiency is increased by the addition of the second impeller and the recirculation tube, as well as the plurality of through holes in the seat, the speed of the separation of the mixture of liquid and the air is increased and the total time necessary to pump the liquid directly from the liquid supply is greatly reduced.

Although the preferred embodiment of the invention is disclosed, alternation and amendment is possible by a person skilled in the art. Therefore, alternation and amendment to the preferred embodiment of the invention without departing from the scope of the invention still fall within the range of the invention. The scope of the invention is not limited to the exemplary disclosure herein and the embodiment described above is intended to be descriptive only and should not be interpreted as a limitation to the invention. Therefore, the scope of the invention should be determined by the appended claims.

What is claimed is:

1. A self-priming centrifugal pump comprising a casing, a motor casing securely mounted in the casing, a channel defined between the casing and the motor casing, a discharge end on top of the casing and in communication with the channel, a rotor mounted within the motor casing, an axle securely mounted to the rotor and rotatably received within the casing, a first set of impellers securely connected with the axle, a hollow cylinder securely connected under the casing and having the first impeller received therein, a first tube communicating with the cylinder through an opening defined to receive the axle extending therethrough, and a supply tube connected between an inlet end of the first tube and a liquid supply; wherein the improvements comprising:

a recirculation tube, a first end of which is in communication with the cylinder and has a second impeller mounted in the first end, a second end of which is in communication with the first tube.

2. The pump as claimed in claim 1 further comprising a plurality of through holes defined to allow the first tube to communicate with the cylinder.

3. A self-priming centrifugal pump comprising a casing, a motor casing securely mounted in the casing, a channel defined between the casing and the motor casing, a discharge end on top of the casing and in communication with the channel, a rotor mounted within the motor casing, an axle securely mounted to the rotor and rotatably received within the casing, a first set of impellers securely connected with the axle, a hollow cylinder securely connected under the casing and having the first impeller received therein, a first tube communicating with the cylinder through an opening defined to receive the axle extending therethrough, and a supply tube connected between an inlet end of the first tube and a liquid supply; wherein the improvements comprising:

a plurality of through holes defined to allow the first tube to communicate with the cylinder.

4. The self-priming centrifugal pump as claimed in claim 3 further comprising comprising a recirculation tube, a first end of which is in communication with the cylinder and has a second impeller mounted in the first end, a second end of which is in communication with the first tube.

* * * * *